US010000989B2

(12) United States Patent
Sherlin

(10) Patent No.: US 10,000,989 B2
(45) Date of Patent: Jun. 19, 2018

(54) RESIN SYSTEM FOR COMPOSITE DOWNHOLE FRAC PLUG AND BRIDGE PLUG TOOLS AND RELATED METHODS

(71) Applicant: CCDI COMPOSITES, INC., Santa Ana, CA (US)

(72) Inventor: Dennis Sherlin, Hacienda Heights, CA (US)

(73) Assignee: CCDI Composites, Inc., Santa Ana, CA (US)

( * ) Notice: Subject to any disclaimer, the term of this patent is extended or adjusted under 35 U.S.C. 154(b) by 465 days.

(21) Appl. No.: 14/209,645

(22) Filed: Mar. 13, 2014

(65) Prior Publication Data

US 2014/0262212 A1 Sep. 18, 2014

Related U.S. Application Data

(60) Provisional application No. 61/779,000, filed on Mar. 13, 2013.

(51) Int. Cl.
*E21B 33/12* (2006.01)
*E21B 33/134* (2006.01)

(52) U.S. Cl.
CPC ..... *E21B 33/1208* (2013.01); *E21B 33/134* (2013.01)

(58) Field of Classification Search
CPC ..... E21B 33/1208; E21B 33/134
See application file for complete search history.

(56) References Cited

U.S. PATENT DOCUMENTS

| | | | | |
|---|---|---|---|---|
| 7,779,928 | B2 * | 8/2010 | Turley | E21B 33/1208 166/118 |
| 2007/0193736 | A1 * | 8/2007 | Corre | E21B 33/1277 166/187 |
| 2009/0200013 | A1 * | 8/2009 | Craster | E21B 17/00 166/242.4 |
| 2010/0156215 | A1 * | 6/2010 | Goertzen | H02K 5/132 310/87 |
| 2015/0251394 | A1 * | 9/2015 | Fukuda | B32B 27/34 428/213 |

* cited by examiner

*Primary Examiner* — D. Andrews
(74) *Attorney, Agent, or Firm* — Klein, O'Neill & Singh, LLP

(57) ABSTRACT

A new resin blend is disclosed, which may be referred to as a hybrid resin. The resin blend includes an effective amount of benzoxazine resin or benzoxazine derivative mixed with at least one of epoxy resin, phenolic resins and other thermosetting polymers at varying ratios.

22 Claims, 4 Drawing Sheets

RESIN SYSTEM FOR COMPOSITE DOWNHOLE FRAC PLUG AND BRIDGE PLUG TOOLS AND RELATED METHODS

FIELD OF ART

The present invention generally relates to apparatus, system, and method involving a unique hybrid resin comprising an effective amount of benzoxazine or a benzoxazine derivative and use of the hybrid resin as a matrix for a composite tool for downhole application.

BACKGROUND

In oil and gas well completion operations, frac or bridge plugs are necessary for zonal isolation and multi-zone hydraulic fracturing processes. The advantages of frac and bridge plugs made primarily from composite materials is well established since these products significantly reduce drill-out (removal) time compared to drill-out time for all metallic frac and bridge plugs. However, as drilling for oil and gas extends deeper underground and/or hydraulic fracking pressures increase, composite frac and bridge plugs are subject to higher pressures and operating temperatures. Additionally, since frac and bridge plugs are expendable items for short term use, it is important to manufacture these products at the lowest cost possible yet still meet performance requirements.

With higher pressures and operating temperatures associated with deep well fracking operations, increased stresses can be expected on frac and bridge plug products. Current composite frac and bridge plugs are made of fiberglass or carbon fiber with an epoxy resin matrix. The epoxy resin matrix softens when subjected to elevated temperatures with a resultant loss in strength of the composite. General purpose heat cured epoxy resins are only suitable for frac or bridge plugs operating in the lower 250 F and 8,000 kpsi service range. Higher performing tetra-functional epoxy resins can be used in the 350 F and 10,000 psi range provided the frac or bridge plug is designed with enough material to handle the stresses. The well completion industry would like to operate deeper fracking processes at higher temperatures and pressures but the heat distortion temperature for the epoxy resin has been a limitation to date.

The options for current commercially available resin systems to be used in downhole tools are limited. There are several resin systems that are known to have higher elevated temperature properties than the best epoxies, such as BMI (bismaleimide) or Cynate Ester resins. However, while these resins have high Tg (glass transition temperatures), they are not widely accepted in the frac and/or bridge plug market due to hydrothermal degradation and high costs. Additionally, retention of mechanical properties is not the only requirement for a resin system suitable for frac and/or bridge plugs. The resin must also have a mixed viscosity that is low enough to be processed by conventional frac plug manufacturing methods (for example, e.g., filament winding or convolute cloth wrap) and have sufficient pot-life for such processing. Consequently tetra-functional epoxies have been the primary resin system used to date for composite frac and bridge plugs.

SUMMARY

Aspects of the present invention generally relate to apparatus, system, and method involving a unique hybrid resin comprising an effective amount of benzoxazine or a benzoxazine derivative and use of the hybrid resin as a matrix for a composite tool for downhole application.

A method of forming at least one of a downhole frac plug product and bridge plug product is disclosed. The method can comprise the steps of mixing a thermosetting polymer with an effective amount of additive; mixing an amount of benzoxazine or benzoxazine derivative to the thermosetting polymer and the additive to form a hybrid resin; coating a plurality of tows comprising a plurality of composite strands or coating a convolute cloth with the hybrid resin; laying the tows or the convolute cloth with the coating of hybrid resin around a mandrel to form a composite layer; and repeating the coating and laying steps to form additional composite layers.

The method wherein the benzoxazine or the benzoxazine derivative can be mixed in a ratio of 5% to 95% wt-wt of benzoxazine or benzoxazine derivative.

The method wherein the strands can comprise fiberglass or carbon fiber material.

The method wherein the thermosetting polymer can be an epoxy resin, a phenolic resin, or a multifunctional resin.

The method can further comprise modifying the ratio to adjust a viscosity value of the hybrid resin.

The method can further comprise applying a final overcoat of hybrid resin over an outermost composite layer.

The method can further comprise forming a composite mandrel comprising a hollow bore.

The method can further comprise forming a composite sleeve for use over a mandrel comprising a hollow bore.

The method can further comprise forming at least part of a composite frac plug or bridge plug.

The method wherein the additive can be a hardener.

The method wherein at least one composite layer can be wound to a 45 degree angle relative to the mandrel and at least one composite layer can be wound to a negative 45 degree angle relative to the mandrel.

The method can further comprise curing the layers in an oven and removing the mandrel.

A further aspect of the present disclosure is a composite tool for use in downhole oil and gas applications. The composite tool can comprise a plurality of composite layers cured with a matrix formed from a hybrid resin, said plurality of layers comprising an inner most layer, an outer most layer, and a lengthwise axis; at least one of the composite layers having fibers turned at a first angle relative to the lengthwise axis and at least one of the composite layers having fibers turned at a second angle relative to the lengthwise axis, which differs from the first angle; and wherein the hybrid resin comprises a blend of thermosetting polymer, an additive, and benzoxazine or benzoxazine derivative in a ratio of 5% to 95% wt-wt of benzoxazine or benzoxazine derivative.

The composite tool can be a composite mandrel comprising a hollow bore. Further, an end of the composite mandrel can have a tapered inlet.

The composite tool can be a component of a frac plug or a bridge plug.

The composite tool wherein the thermosetting polymer can be an epoxy resin, a phenolic resin, or a multifunctional resin.

The composite tool wherein the additive can be a hardener.

The composite tool wherein the outer most layer can comprise an outer coating of cured hybrid resin.

The composite tool can further comprise at least one layer having fibers turned at a third angle, which differs from the first angle and the second angle.

A still further feature of the present disclosure is a method for using a resin blend, said resin comprising benzoxazine as the matrix resin with fiberglass or carbon fiber materials for composite down hole frac and bridge plug products to enhance elevated temperature strength properties and resistance to the down hole environment. The new resin blend has enhanced hot/wet performance in down hole frac and bridge plug applications in a cost effective manner with ease of processing.

Yet another feature of the present disclosure is a method for forming or making a resin blend, said method comprising blending benzoxazine resin with epoxy resin, phenolic resin or other thermosetting polymers at varying ratios to form a new hybrid resin system.

The method can further comprise modifying the ratio to adjust the resin viscosity.

Another feature of the present disclosure is a method of using a resin blend, said resin blend comprising benzoxazine resin blended with at least one of epoxy resin, phenolic resin and other thermosetting polymers at varying ratios and with at least one of fiberglass and carbon fiber materials, wherein said method comprising applying the resin blend with fiber elements.

The method can further comprise using the resin blend and the fiber elements in a filament winding or convolute cloth wrapping process.

The method can further comprise forming at least part of a composite frac plug or bridge plug.

A still yet further feature of the present disclosure is a method for forming a resin blend, said method comprising the steps of blending benzoxazine resin with epoxy resin to form a hybrid resin system with enhanced hydrophobic properties.

The method can further comprise using the resin to form part of a down hole frac plug or bridge plug.

A still yet further method can comprise blending benzoxazine resin and nano particle (CSR) core shell rubber products to form a hybrid resin system.

The method can further comprise applying the hybrid resin system to fiber elements to form at least part of a down hole frac plug or bridge plug having at least one of enhanced elevated temperature properties, enhanced resin toughness, and leak resistant composite product qualities.

The method can also include blending benzoxazine resin and CSR nano particles with acetone to create a hybrid resin system.

The method wherein the resin blend can comprise a viscosity value sufficient for use for filament winding at least one of down hole frac plug product and bridge plug product.

The method can further comprise causing acetone in the resin blend to evaporate during the winding process after fiber wet-out.

An apparatus of the present disclosure can include a downhole tool formed with a resin blend comprising benzoxazine resin and nano particle (CSR) core shell rubber products.

A downhole tool formed with a resin blend comprising benzoxazine resin blended with at least one of epoxy resin, phenolic resin and other thermosetting polymers.

A downhole tool formed with a resin blend comprising benzoxazine as the matrix resin with fiberglass or carbon fiber materials.

BRIEF DESCRIPTION OF THE DRAWINGS

These and other features and advantages of the present device, system, and method will become appreciated as the same becomes better understood with reference to the specification, claims and appended drawings wherein:

DESCRIPTION

The detailed description set forth below in connection with the appended drawings is intended as a description of the presently preferred embodiments of resin systems for use with high strength composite components made using fiber roving strands in a filament winding process or convolute cloth wrap process provided in accordance with aspects of the present device, system, and method and is not intended to represent the only forms in which the present device, system, and method may be constructed or utilized. The description sets forth the features and the steps for constructing and using the embodiments of the present device, system, and method in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

It would be desirable to have a frac and/or bridge plug resin system that performs at higher temperatures and pressures than epoxy resin and still can be easily processed by conventional methods for making frac and bridge plugs, such as filament winding or convolute cloth wrap, and is cost effective for the application. Preferably, the epoxy resin is superior at elevated temperatures and pressures typically experienced for downhole oil and gas applications. Hereinbelow described, benzoxazine or one of many benzoxazine derivatives is blended with an epoxy resin, such as tetrafunctional epoxy resin, BMI (bismaleimide) resin, or cynate ester resins, in different wt-wt ratio to form a resin system for use as a matrix for a composite downhole tool, which is believed to have not been used to date for downhole oil and gas applications.

Figure 1:
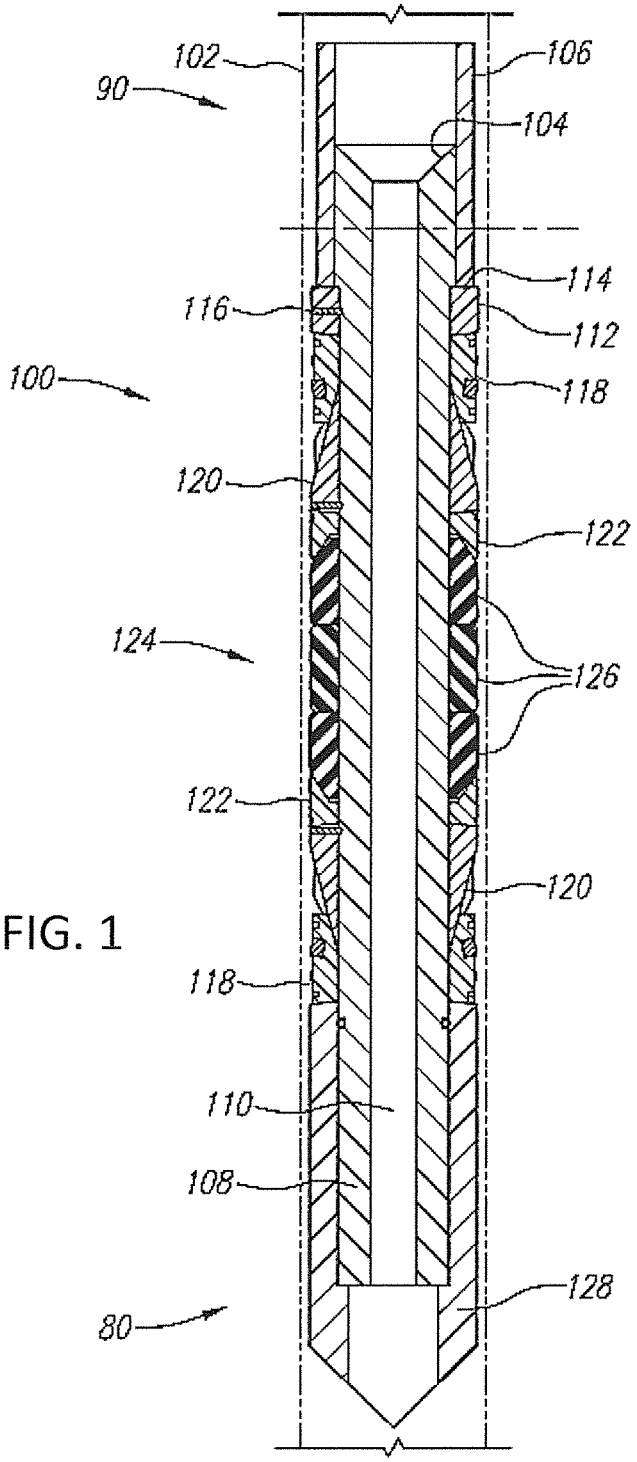
FIG. 1 is a schematic side view of a downhole tool formed, at least in part, in accordance with the methods and techniques of the present disclosure.

With reference now to FIG. 1, a downhole tool 100 provided in accordance with aspects of the present disclosure is shown situated in a well bore 102, which can be a production casing, an intermediate casing, or a surface casing. The downhole tool 100 is a frac plug system and includes a ball seat 104 for receiving a closing ball or frac ball (not shown). However, in other embodiments, the downhole tool can be a bridge plug that utilizes the high strength winding method and system of the present disclosure involving blow roving strands.

As shown, the tool 100 has a first end 90 and a second end 80 and a mandrel 108 running through the tool, which may be a composite formed by winding roving strands comprising loops for bridging between adjacent layers. A sleeve 106 is shown attached to the mandrel 108, which has a bore 110 for fluid flow. In one example, the sleeve 106 is attached to the mandrel 108 without any pin, i.e., a pin-less connection. In alternative embodiments, one or more pins are used to secure the sleeve and the mandrel in combination with adhesive, as further discussed below. As further discussed below, the sleeve 106 may also be made from a composite material comprising blown roving strands.

A spacer ring 112 is abutted against a shoulder 114 defined by the sleeve 106 and optionally pinned to the sleeve with one or more pins 116. The spacer ring 112 supports a slip back up or slip ring 118, which has a tapered interior surface for riding up against a tapered surface of the slip wedge 120 to bite against the casing when set. A second set of slip wedge 120 and slip ring 118 is provided closer to the second end 80 for gripping the tool assembly 100 against the casing.

A packer shoe 122 is provided adjacent the packer assembly 124, which in the current embodiment has three packer rings 126. In other examples, a different number of packer rings is used, such as one, two, or more than three. The upper and lower packer shoes 122 are configured to compress the packer assembly 124 when the downhole tool 100 is set, which causes the three packer rings 126 to expand outwardly away from the mandrel 108 to seal against the casing.

A nose section 128 is provided at the second end 80 of the downhole tool 100, which may be used to engage a crown (not shown) of another downhole tool. In the present embodiment, the nose section 128 is attached to the mandrel 108 without any pin, i.e., a pin-less connection. In alternative embodiments, one or more pins are used to secure the nose section 128 and the mandrel in combination with adhesive, as further discussed below. In yet other examples, the nose section 128 is threaded to the mandrel 108.

It has been found that benzoxazine monomers can be polymerized to form a benzoxazine polymer or can be mixed with other resins in a manner such that, when polymerized, will create a new hybrid polymer having benzene rings with a backbone that contains benzoxazine. Benzoxazine has the advantage of withstanding high temperature and corrosive environments for downhole frac and bridge plug applications.

Benzoxazine can be formulated to be hydrophobic, which is advantageous in downhole environment. Among other things, a composite downhole tool, such as a mandrel, a sleeve, or any component of a frac plug or bridge plug with the benzoxazine-based resin system of the present disclosure can better resist moisture and fluid permeation through the walls of the composite structure, which can be a weakness and a failure point in prior art downhole tools.

The blending of benzoxazine with a tetra-functional epoxy in varying ratios creates a new hybrid resin system with a higher Tg than can be achieved with epoxy and improved retention of mechanical properties in a hot/wet and corrosive environment. Since the option exists to only blend a portion of benzoxazine with epoxy for this new resin system, the cost is not dramatically increased. However, as costs of benzoxazine and benzoxazine derivatives come down, pure benzoxazine resin and benzoxazine derivatives can be used as the matrix for composite downhole tools. A properly selected ratio of benzoxazine and epoxy can increase the performance of a frac or bridge plug into the 450 F and 14,000 psi fracking regime. In one example, benzoxazine is blended in a 5% to 95% wt-wt ratio with a tetra-functional epoxy to form a resin system, i.e., a hybrid resin, of the present embodiment.

Figure 2:
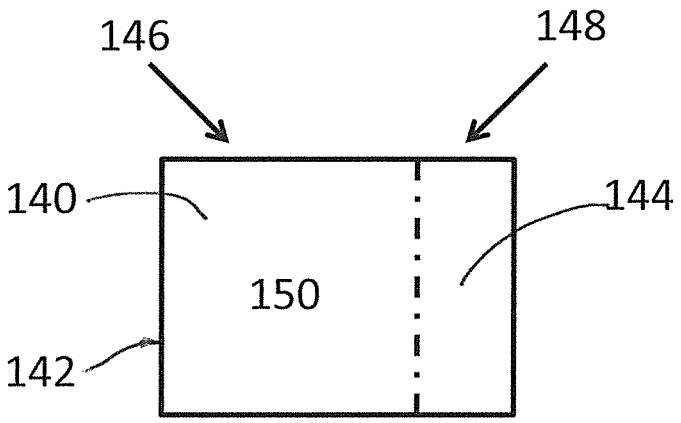
FIG. 2 is a reservoir showing a base resin mixture.
Figure 3:
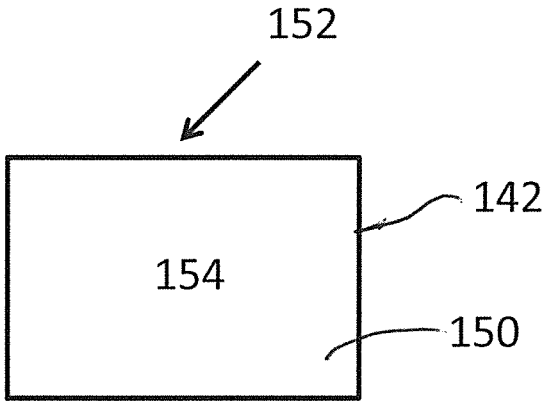
FIG. 3 is a reservoir showing an epoxy resin-benzoxazine based admixture in accordance with aspects of the present system and method.

In one embodiment, the mandrel 108, the sleeve 106, or any of the composite components used in the downhole tool 100 of FIG. 1 may be fabricated using composite strands, called tows or rovings, impregnated with a resin system or hybrid resin of the present disclosure, as further discussed below. With reference now to FIG. 2, a reservoir is shown 140 comprising an imaginary wall depicting two different sizes or ratio of two different blends within the reservoir. The first compartment or component 142 is substantially larger than the second compartment or component 144. The two compartments represent a typical resin blend comprising a multifunctional epoxy resin with an aromatic amine hardener in a 90% stoichiometric mix ratio. In one example, a 100 gr sample of Huntsman MY721 multifunctional epoxy resin 146 is added to the reservoir and mixed with 18 grams of Hexion Epikure W aromatic amine hardener 148 to form a base resin mixture 150. The mixture 150 is blended to an even mix before further mixing to a final blend. However, most epoxy resins for composite winding, such as the EPOTEC epoxy resin from Harke Composites and US Composites, phenolic resin, such as those offered by Plenco or Georgia-Pacific Chemicals, or other thermosetting polymers may be used instead of the Huntsman brand.

With reference now to FIG. 2, a blend of benzoxazine resin or a benzoxazine derivative 152 is then added to the base mixture 150 inside the reservoir 142. In one example, 30 gram of benzoxazine resin is added to the base mixture 150 to form a new resin system 154, i.e., a hybrid resin 154, comprising benzene rings with a backbone that contains benzoxazine, i.e., a resin admixture having a trace amount of benzoxazine. The admixture is thoroughly mixed to an even blend. A range of 5% to 95% wt-wt ratio of benzoxazine resin or benzoxazine derivatives are contemplated to yield a preferred resin system of the present disclosure having hydrophobic properties and strength for downhole applications. Additional additives may be added to the hybrid system, such as blend of product to the control the viscosity or foaming of the final admixture. In one example, acetone is added to the hybrid resin 154 to facilitate soaking of the composite strands and winding of the strands. The admixture with a sufficient amount of acetone may be used at higher than room temperature to promote evaporation of the acetone during the laying or winding process after fiber wet-out.

Benzoxazine is defined as a molecule where the oxazine ring (a heterocyclic six-member ring with oxygen and nitrogen atom) is attached to a benzene ring. There are numerous benzoxazine derivatives depending on the position of the oxygen and nitrogen in the ring and are available from SIGMA-ALDRICH with worldwide offices in the USA and abroad and with corporate headquarters in St. Louis, Mo. Benzoxazine and its derivatives are usable with an epoxy resin, such as tetra-functional epoxy resin, BMI (bismaleimide) resin, or cynate ester resins, in different wt-wt ratio to form a resin blend of the present disclosure. Exemplary benzoxazine and its derivatives include to the following non-limiting examples: $C_8H_5Cl_2NO_4S$; $C_8H_5NO_3$; $C_8H_6BrNO_2$; $C_8H_4ClNO_3$; $C_8H_4ClNO_3$; $C_8H_8N_2O_2$; $C_8H_8N_2O_2$; $C_8H_9NO$; $C_8H_9NO_2$; $C_9H_8ClNO_4S$; $C_9H_8ClNO_4S$; $C_9H_9NO_2$; $C_9H_{10}ClNO_3S$; $C_{21}H_{18}ClNO_2$; C10H13ClN2O2; and $C_{10}H_8ClNO_4$. Additionally, 100% benzoxazine resin or benzoxazine derivatives may be used as the matrix for the composite stands for winding workable downhole tools.

Fiberglass strands called rovings are used for filament winding, which may be used to form the mandrel 108 and/or the sleeve 106 described herein. In other examples, other materials such as carbon fiber is used in conjunction with or instead blown glass roving. The rovings for winding can be bundled strands or woven roving cloth, in which large strands are weaved into sheets. Typical rovings are made from a collection of glass filaments. In other examples, other composite materials are used, such as carbon and aramid. The filaments are smooth, have relatively constant diameter, generally equal in length, and are bundled together to make a roll of roving material, also called a tow. However, non-smooth filaments or other filament types can be used with the present hybrid resin 154.

Figure 4:
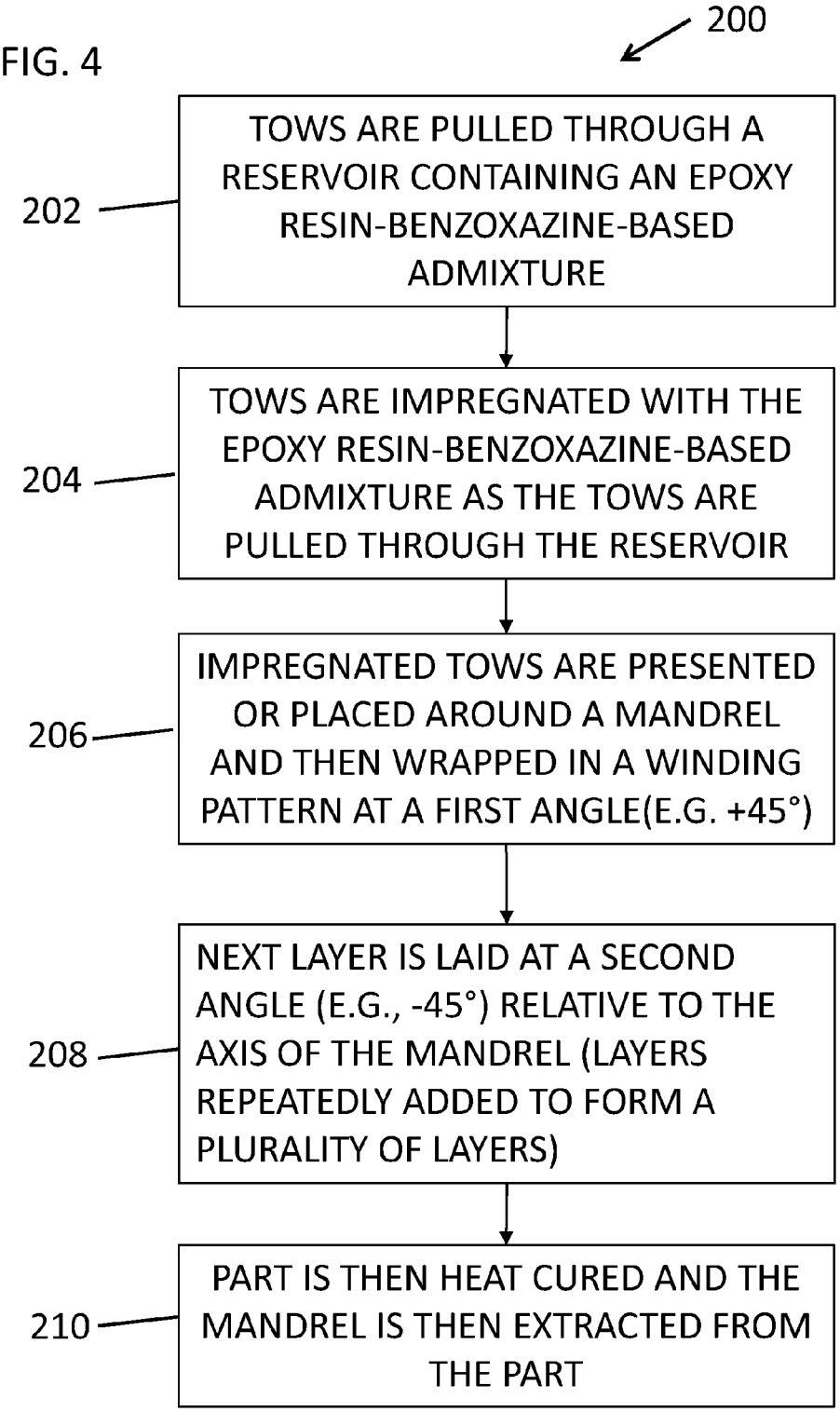
FIG. 4 is schematic process flow diagram showing the steps for forming a downhole tool using the epoxy resin-benzoxazine based admixture of the present disclosure.

With reference now to FIG. 4, a schematic flow diagram depicting a process or method 200 for fabricating a downhole tool using the resin system of the present disclosure is shown. The process can be either a wet hand layup or manual process or a computer filament winding process.

At step 202, a series of tows are pulled through a reservoir containing the epoxy resin-benzoxazine-based admixture or hybrid resin 154 of the present disclosure, which comprises an admixture of benzoxazine or benzoxazine derivative, an epoxy resin, and a hardener in a 5% to 95% wt-wt ratio of benzoxazine or benzoxazine derivative. Each tow is a group of very fine filaments. In one example, there may be up to 24000 filaments or more in a single tow. There may be as many as 20 or more tows pulled at a time.

At step 204, the tows are impregnated with the epoxy resin-benzoxazine-based admixture or hybrid resin 154 of the present disclosure as the tows are pulled through the reservoir 142 containing the admixture 154. In one example, additives are added to the admixture 154 to adjust the viscosity of the admixture and reduce the amount of foaming due to the agitation of admixture by the tows as they are being pulled.

In one example, the impregnation process can be performed in a bath where the tows are submerged into the bath and are guided over several round bars to mechanically work the resin admixture 154 into the tows. In another example, the admixture can be used with a drum where part of the drum is in the resin admixture 154. The tows are pulled over the top of the drum. There is tension on the tows that makes the drum turn as the tows are pulled through the system. The hybrid resin 154 of the present disclosure is picked up on the immersed part of the drum and then transferred to the tows at the top.

At step 206, the impregnated tows are presented or placed around a mandrel and then wrapped around the mandrel in a winding pattern. The mandrel should have the shape of the final product to be formed by the winding process. The mandrel is subsequently removed from the cured tows to leave behind a composite tool.

In one example, the computer controls the speed of the turning mandrel and the transverse speed of the bath. By varying these speeds, the tows can be placed on the mandrel at various angles. A typical part will have the tows placed at +1-45° angles relative to the axis of the mandrel. For example, at step 206, the tows are laid at a +45° angle relative to the axis of the mandrel and then at step 208, the next layer is laid at a −45° angle relative to the axis of the mandrel. The process is repeated until a desired thickness or profile is achieved.

If a section of the component to be made or the entire component requires radial crush strength, some layers can be laid down at 85° angle relative to the axis of the mandrel. If the part, such as a section or the entire component, requires strength along the axial direction, some layers are laid up at a lower angle, such as 9° angle relative to the axis of the mandrel. The computer can be programmed to put one layer at a time of an angle specified by the functionality of the part until the proper thickness is achieved.

Once sufficient composite layers are laid on the mandrel, the part is then heat cured and the mandrel is then extracted from the part at step 210.

The hand layup process is similar to the method 200 described with reference to FIG. 4 except the fiber is usually a woven cloth. The cloth is placed into a bath and impregnated with the resin admixture 154 of the present disclosure. The impregnated fiber is then laid onto the mandrel by hand.

Optionally, a final overcoat or several final overcoats of the resin admixture 154 are applied to the final layer to form a thickened layer resin-benzoxazine-based admixture.

Figure 5:
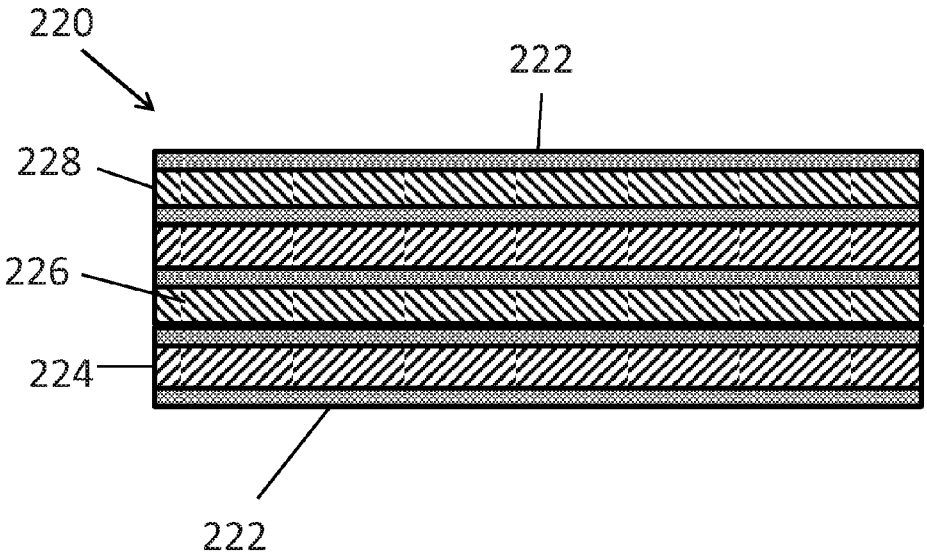
FIG. 5 is a schematic depiction of a plurality of composite layers fixed within a matrix.

FIG. 5 is a schematic depiction of a wall structure 220 formed by the processes described with reference to FIG. 4. As shown, the wall structure 220 comprises a plurality of composite layers 224, 226, 228 fixed within a matrix 222. The composite layers each comprises a plurality of fibers. The wall structure 220 has an inner most layer 224 and an outer most layer 228 and can represent a sleeve, a mandrel or any components of a frac plug or bridge plug with the benzoxazine based resin system of the present disclosure. One of the composite layers 224 can have fibers turned at a first angle relative to a lengthwise axis of the component formed by the wall structure 220 and another composite layer 226 having fibers turned at a second angle relative to the lengthwise axis.

A further aspect of the present disclosure is a method for forming a resin blend, said method comprising blending benzoxazine resin and nano particle (CSR) core shell rubber products to form a hybrid resin system. The hybrid resin system can then be used as a substitute for the admixture 154 described with the process of FIG. 4 for downhole frac and/or bridge plug applications with enhanced elevated temperature properties, enhanced resin toughness, and leak resistant composite product qualities.

Although limited methods and embodiments for forming a composite tube or mandrel using a blend of standard and blown roving strands and their components have been specifically described and illustrated herein, many modifications and variations will be apparent to those skilled in the art. Also, well known processes within the composite manufacturing industry has not been described, such as curing time and temperature and the type of resins that can be used. Similarly, while glass, carbon fiber and other specific composite materials have been identified, other commercially available fibers may be used provided fiber bands comprising blown fiber rovings are incorporated. Accordingly, it is to be understood that the composite tube or mandrel for high pressure and temperature applications constructed according to principles of the disclosed device, system, and method may be embodied other than as specifically described herein. The disclosure is also defined in the following claims.

The invention claimed is:

1. A composite tool for use in downhole oil and gas applications comprising:

a first elongated wall structure having a length extending between a first end and a second end, said elongated wall structure is formed with a plurality of composite layers cured with a matrix formed from a hybrid resin so that the plurality of composite layers are fixed within the matrix, said plurality of layers comprising an inner most layer, an outer most layer, and a lengthwise axis;

at least one of the composite layers having fibers turned at a first angle relative to the lengthwise axis and at least one of the composite layers having fibers turned at a second angle relative to the lengthwise axis, which differs from the first angle;

a second elongated wall structure having a length extending between a first end and a second end, said elongated wall structure is formed with a plurality of composite layers cured with the matrix so that the plurality of composite layers of the second elongated wall structure are fixed within the matrix, said plurality of layers comprising an inner most layer, an outer most layer, and a lengthwise axis;

wherein the first elongated wall structure surrounds the second elongated wall structure; and wherein the hybrid resin consists of a blend of a thermosetting polymer, one or more additives, and a benzoxazine or a benzoxazine derivative in a ratio of 5% to 95% wt-wt of the benzoxazine or the benzoxazine derivative, said one or more additives consisting of a hardener, acetone, a foam controlling agent, and a viscosity controlling agent.

2. The composite tool of claim 1, wherein the wall structure of the first elongated wall structure forms at least part of a sleeve with a hollow bore.

3. The composite tool of claim 1, wherein the wall structure of the second elongated wall structure forms a hollow bore.

4. The composite tool of claim 1, wherein the tool is a component of a frac plug or a bridge plug.

5. The composite tool of claim 4, wherein the component is formed by applying the plurality of composite layers around a mandrel, heating the plurality of composite layers, and removing the mandrel.

6. The composite tool of claim 1, wherein the thermosetting polymer is an epoxy resin, a phenolic resin, a tetra-functional epoxy resin, a bismaleimide (BMI) resin, a cynate ester resin, or a multifunctional resin.

7. The composite tool of claim 6, wherein the additive is the hardener and the acetone.

8. The composite tool of claim 7, wherein the hardener is an aromatic amine hardener.

9. The composite tool of claim 1, wherein the outer most layer comprises an outer coating of cured hybrid resin.

10. The composite tool of claim 1, further comprising at least one layer having fibers turned at a third angle, which differs from the first angle and the second angle.

11. A composite tool for use in downhole oil and gas applications comprising:

a wall structure formed with a plurality of composite layers cured with a matrix formed from a hybrid resin so that the plurality of composite layers are fixed within the matrix to form an elongated structure having a length and a hollow bore for use downhole, said plurality of layers of the wall structure comprising an inner most layer circumscribing the hollow bore, an outer most layer, and a lengthwise axis;

at least one of the composite layers having fibers turned at a first angle relative to the lengthwise axis and at least one of the composite layers having fibers turned at a second angle relative to the lengthwise axis, which differs from the first angle; and wherein the hybrid resin comprises a first admixture of a thermosetting polymer and an effective amount of an additive mixed with a benzoxazine or a benzoxazine derivative in a ratio of 5% to 95% wt-wt of the benzoxazine or the benzoxazine derivative;

the hybrid resin consisting essentially of the thermosetting polymer, the benzoxazine or the benzoxazine derivative, and one or more additives, said one or more additives consisting of a hardener, acetone, a foam controlling agent, and a viscosity controlling agent.

12. The composite tool of claim 11, wherein the elongated structure is located around a mandrel comprising a hollow bore.

13. The composite tool of claim 12, wherein an end of the composite tool has a tapered inlet defining a ball seat.

14. The composite tool of claim 12, wherein the mandrel with the hollow bore is formed with a wall structure having a plurality of composite layers cured with the matrix so that the plurality of composite layers of the second elongated wall structure are fixed within the matrix, said plurality of layers comprising an inner most layer, an outer most layer, and a lengthwise axis.

15. The composite tool of claim 11, wherein the composite tool is a component of a frac plug or a bridge plug.

16. The composite tool of claim 15, wherein the component is formed by applying the plurality of composite layers around a mandrel, heating the plurality of composite layers, and removing the mandrel.

17. The composite tool of claim 11, wherein the thermosetting polymer is an epoxy resin, a phenolic resin, a tetra-functional epoxy resin, a bismaleimide (BMI) resin, a cynate ester resin, or a multifunctional resin.

18. The composite tool of claim 17, wherein the additive is a hardener.

19. The composite tool of claim 18, wherein the plurality of composite layers are formed with winding roving strands comprising loops that bridge between adjacent layers of the composite layers.

20. The composite tool of claim 11, wherein the outer most layer comprises an outer coating of cured hybrid resin.

21. The composite tool of claim 20, further comprising at least one composite layer having fibers turned at a third angle, which differs from the first angle and the second angle.

22. The composite tool of claim 11, wherein the hardener is an aromatic amine hardener.

* * * * *